United States Patent [19]

Baron et al.

[11] 4,397,349

[45] Aug. 9, 1983

[54] HEAT EXCHANGER WITH IMPROVED TUBE CLEANING ELEMENT BASKET RETAINING

[75] Inventors: Walter J. Baron; Laird C. Cleaver, both of Milwaukee, Wis.

[73] Assignee: Water Services of America, Inc., Milwaukee, Wis.

[21] Appl. No.: 350,016

[22] Filed: Feb. 18, 1982

[51] Int. Cl.[3] ..... F28G 1/12; F28G 15/02

[52] U.S. Cl. ..... 165/95; 15/3.51

[58] Field of Search ..... 165/95; 15/3.51

[56] References Cited

U.S. PATENT DOCUMENTS 3,319,710 5/1967 Heeren et al. ..... 165/95

4,124,065 11/1978 Leitner et al. ..... 165/95

FOREIGN PATENT DOCUMENTS 2127715 12/1972 Fed. Rep. of Germany ..... 165/95

*Primary Examiner*—Sheldon J. Richter

*Attorney, Agent, or Firm*—Andrus, Sceales, Starke & Sawall

[57] ABSTRACT

A heat exchanger has a plurality of fluid flow tubes secured adjacent their ends by tube sheets. Cleaning elements are adapted to shuttle back and forth in the tubes and are adapted to be captured by baskets. The baskets are positioned so that their basket holding chambers having fluid flow openings in the side walls thereof are disposed in the space between a retaining plate and tube sheet. The outer end portions of the baskets are engaged by the retaining plate while the inner end portions of the baskets are positioned relative to the tube sheet openings to be in fluid communication with the heat exchanger tubes. The retaining plate has a plurality of openings therein which may be in axial alignment with the tube sheet openings and in axial registry with the open outer ends of the baskets. Alternately, the retaining plate openings may be arranged in a random pattern basically out of alignment with the tube sheet openings and out of registry with the baskets. The total cross-sectional area of the random openings in a retainer plate is preferably equal to or greater than the sum of the internal cross-sectional areas of the heat exchanger tubes.

10 Claims, 7 Drawing Figures

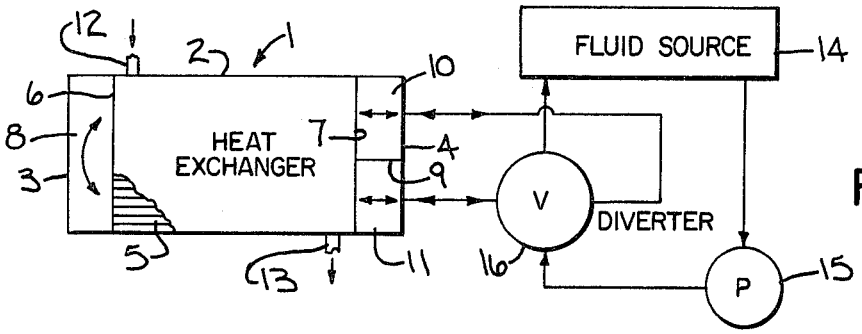
FIG.1
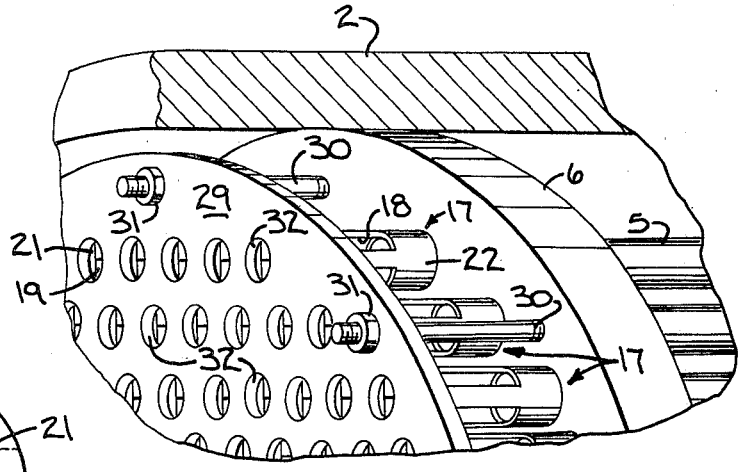
FIG.2
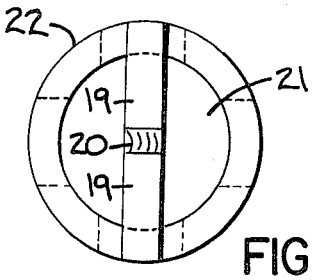
FIG.4
FIG.3
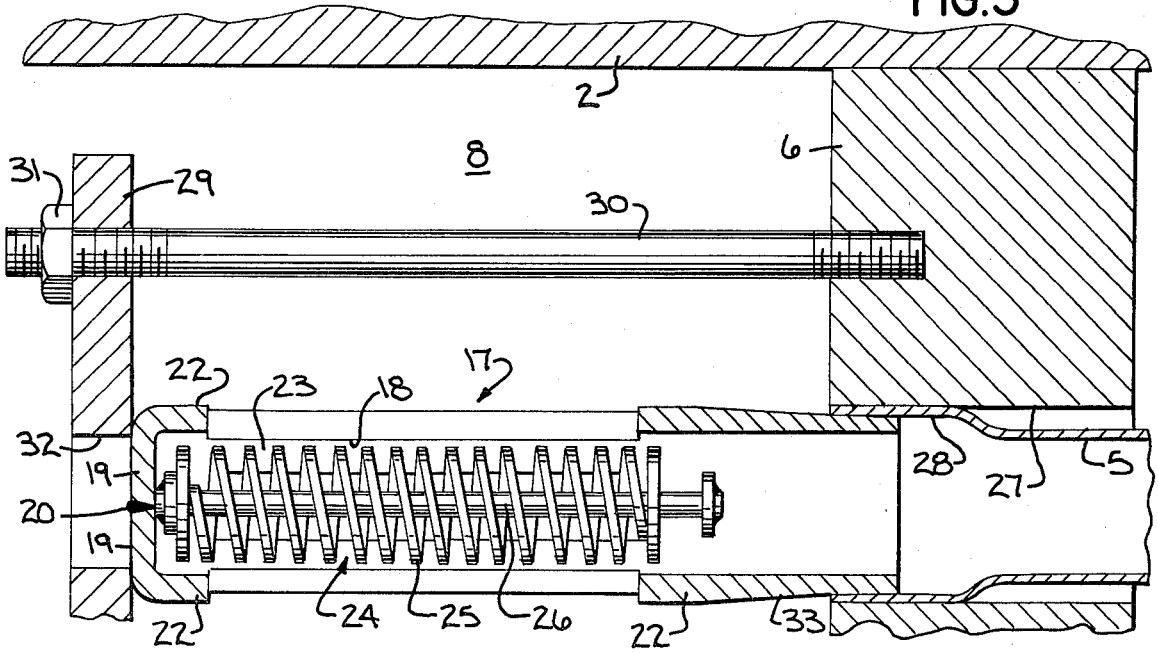

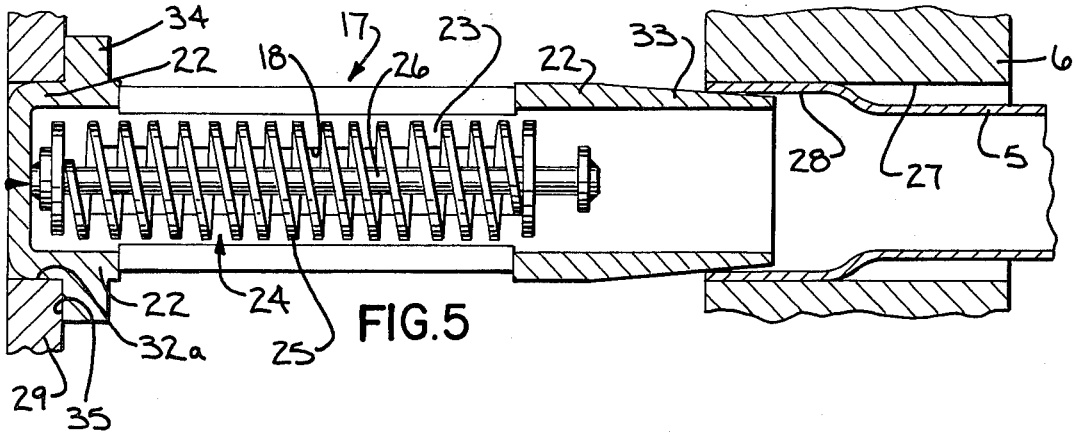
FIG.5
FIG.6
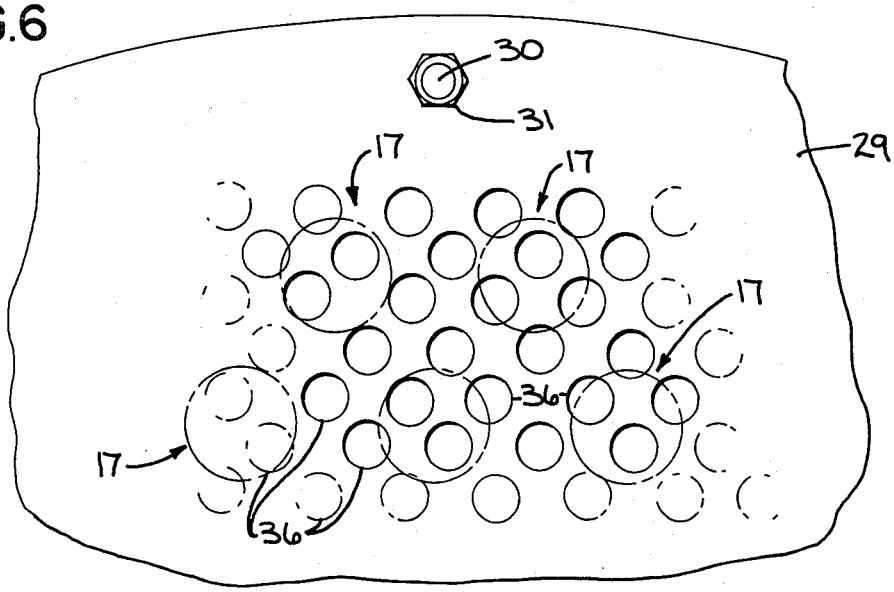
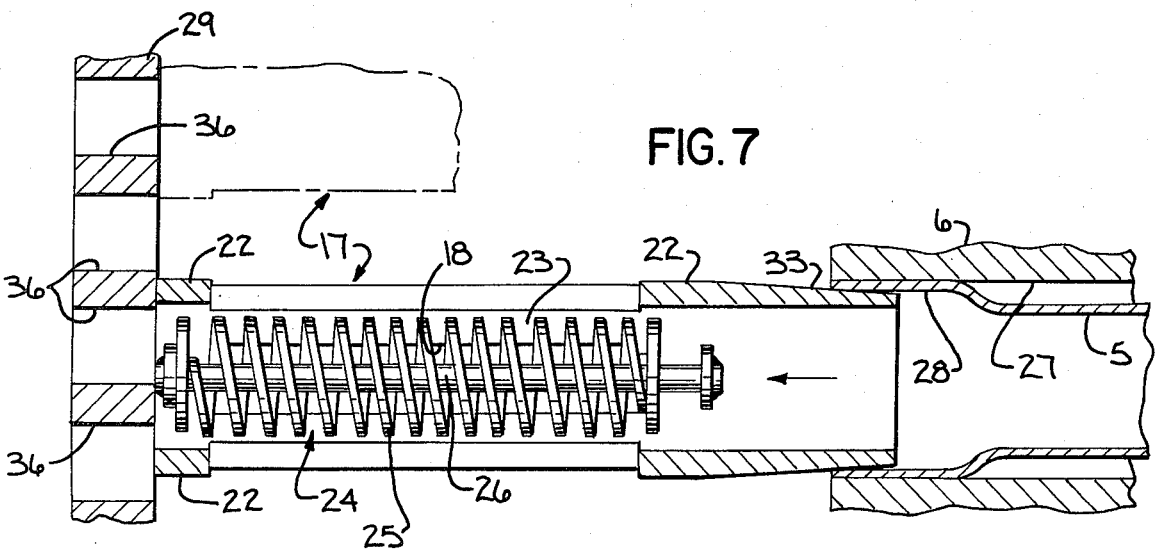
FIG. 7

HEAT EXCHANGER WITH IMPROVED TUBE CLEANING ELEMENT BASKET RETAINING

U.S. PRIOR ART OF INTEREST

| U.S. Pat. No. | Inventor | Issued |
|---|---|---|
| 3,319,710 | Heeren et al. | May. 16, 1967 |
| 4,124,065 | Leitner et al. | Nov. 7, 1978 |

BACKGROUND AND SUMMARY OF THE INVENTION

This invention relates to shuttle cleaning of heat exchanger tubes and is an improvement over the concepts disclosed in the above-identified patents.

It is known from the above-identified patents to connect individual elongated cleaning element capturing cages or baskets to both ends of longitudinally extending tubes disposed in a heat exchanger housing. The tube ends are held in position at both ends by transverse tube sheets. The baskets are adapted to contain shuttlable cleaning elements, such as brushes. Fluid flowing in one direction through the tubes keeps the cleaning elements captured within their respective basket chambers, while the fluid discharged outwardly through slot-like openings in the basket walls. Upon reversal of fluid flow, the cleaning elements are forced out of their baskets and through the tubes to the baskets at the opposite tube ends to thereby perform a tube cleaning action.

Reference is made to the present inventors' co-pending U.S. patent application Ser. No. 350,286, filed on even data herewith and entitled "Basket Retainer For Heat Exchanger Tube Cleaning Element". In that application, a basket retaining plate is fixedly mounted, as by bolts or the like, in spaced relationship outwardly from the outer tube sheet face. The plate and its mount cooperate with the tube sheet to hold the baskets in fixed position relative to the tube sheet and tube ends. The outer capturing and holding portions of the baskets extend outwardly from the retaining plate. The baskets include central or intermediate portions which extend through openings in the plate and inner portions which extend through the space between the plate and tube sheet and which terminate within the tube sheet. The baskets are fixedly secured against transverse shifting by a two-point support, one at the inner basket ends and one intermediate their ends. To hold the baskets in longitudinally fixed position, and in one embodiment, the basket intermediate portions are threaded to the retaining plate. In another embodiment, shoulders adjacent the inner basket ends engage the plate and tube sheet. The retaining plate is of lesser diameter than the tube sheet and is provided with unobstructed fluid flow openings between the baskets and basket-receiving openings.

In some instances, as where there is little space available between the retaining plate and the heat exchanger head end or when only short baskets are desired, it is not feasible to dispose the baskets longitudinally outwardly of the retaining plate as is shown in the aforementioned application.

It is a task of the present invention to provide the advantages of the retaining plate even when the baskets do not extent outwardly thereof.

In accordance with the various aspects of the invention, the baskets are positioned so that their basket holding chambers having fluid flow openings in the side walls thereof are disposd in the space between the retaining plate and tube sheet. The outer end portions of the baskets are engaged by the retaining plate while the inner end portions of the baskets are positioned relative to the tube sheet openings to be in fluid communication with the heat exchanger tubes. The retaining plate has a plurality of openings therein which may be in axial alignment with the tube sheet openings and in axial registry with the open outer ends of the axial baskets. Alternately, the retaining plate openings may be arranged in a random pattern basically out of alignment with the tube sheet openings and out of registry with the baskts. The total cross-sectional area of the random openings in a retainer plate is preferably equal to or greater than the sum of the internal cross-sectional areas of the heat exchanger tubes.

BRIEF DESCRIPTION OF THE DRAWINGS

The accompanying drawings illustrate the best mode presently contemplated by the inventors for carrying out the invention.

In the drawings:

FIG. 1 is a schematic showing of a heat exchanger and fluid flow controls therefor;

FIG. 2 is a fragmentary perspective view of a portion of the heat exchanger interior and showing the baskets disposed between the tube sheet and retaining plate;

FIG. 3 is a longitudinal section showing one embodiment of basket mount;

FIG. 4 is an outer end view of a basket;

FIG. 5 is a longitudinal section showing another embodiment of basket mount;

FIG. 6 is front view of the outer face of a retaining plate having openings arranged in a random pattern; and FIG. 7 is a longitudinal section through a mount in accordance with FIG. 6.

DESCRIPTION OF THE PREFERRED EMBODIMENT

The present invention is directed to tube-type heat exchangers. A schematic showing of such an exchanger and its fluid flow controls is shown in FIG. 1. The exchanger 1 comprises a cylindrical housing 2 having end closure heads 3 and 4, and a plurality of longitudinally extending tubes 5 therein. The exposed open ends of tubes 5 are connected to circular transverse tube sheets 6 and 7 which are spaced from the respective end heads 3 and 4. Head 3 and tube sheet 6 form one fluid flow chamber 8, while a partition 9 separates the space between head 4 and tube sheet 7 into a pair of fluid flow chambers 10 and 11. Heat exchanging fluid is introduced through an inlet 12 to the area around tubes 5 and discharges through an outlet 13.

Heat exchanger 1 is also connected to a fluid source 14, a pump 15 and a fluid diverter valve 16 by various conduits in the conventional manner. Fluid is directed through tubes 5 via chambers 10, 8 and 11, in that order or in reverse order, depending on the position of valve 16.

Heat exchanger 1 is provided with tube cleaning means. For this purpose, the ends of each tube 5 are connected to a capturing device which in the present embodiment comprises a longitudinally extending elongated slotted basket 17 which is coaxial with the tube and made of metal or other suitable material. The basket is slotted at 18. The inside diameters of tube 5 and basket 17 are about the same. The outer end of each basket 17 is provided with a pair of narrow tabs 19 which are folded over and joined, as by a weld 20, to form an abutment. Tabs 19 are of such a width that substantial fluid flow spaces 21 are provided in the basket outer end, which can be regarded as essentially open. In some instances, and depending upon the arrangement of the parts, such as in FIGS. 6 and 7, the basket end may be fully open if desired.

Each basket includes a cylindrical wall 22 containing the fluid flow openings or slots 18 therein and forms a capturing chamber 23 for holding a tube cleaning device 24 which is adapted to shuttle back and forth between end baskets within its respective tube 5 upon reversal of fluid flow by valve 16. Device 24 may be of any desired type, that shown having a coil spring 25 shiftable along a central rod 26.

In the present embodiment, each tube 5 is shown as entering an opening 27 in tube sheet 6 and having an opening 27 in tube sheet 6 and having an enlarged end portion 28 which fits tightly within the outer end of the opening. A generally circular transverse retaining plate 29 is disposed outwardly in spaced relationship from and generally parallel to tube sheet 6 within chamber 8. Means are provided to fixedly secure retaining plate 29 relative to tube sheet 6. For this purpose, and in the present embodiment, a plurality of circumferentially spaced bolts 30 threadably extend through plate 29 and into threaded engagement within tube sheet 6. Nuts 31 on the outer threaded bolt ends serve to lock plate 29 in position on the bolts. The longitudinal spacing between plate 29 and tube sheet 6 may be changed by adjusting the bolts.

The mounted plate 29 cooperates with tube sheet 6 to hold each basket 17 in position relative to tube sheet 6 and the end of tube 5.

As shown in FIGS. 2 and 3, plate 29 is provided with a plurality of spaced fluid flow openings 32 which are disposed in axial alignment with tube sheet openings 27.

During assembly, baskets 17, which have tapered inner end portions 33, are telescopingly fit into enlarged tube portions 28 so that the baskets are coaxial with tube sheet openings 27 and in fluid communication with tubes 5. Retaining plate 29 is then bolted down to tube sheet 6. Each basket will be confiningly engaged by plate 29 and positioned with slots 18 disposed between plate 29 and tube sheet 6. Furthermore, each opening 32 will be in axial registry with its basket 17.

In the embodiment of FIG. 3, the openings 32 are smaller in diameter than the outer end of baskets 17. In this instance, the peripheral portion of plate 29 surrounding an opening 32 confiningly engages the outer basket end.

In some instances, it may be desirable for the peripheral portion of plate 29 to confiningly engage an abutment on the outer end portion of basket wall 22. In the embodiment of FIG. 5, plate opening 32*a* is approximately equal in diameter to wall 22 and the latter is provided with a fixed abutment shown as an annular ring 34 having a shoulder 35 which is engaged by plate 29.

The embodiment of FIGS. 6 and 7 shows a slightly different construction wherein plate 29 is provided with a plurality of spaced openings 36 which are arranged in a random pattern so that few, if any, of the openings are in axial alignment with tube sheet openings 27. Openings 36 are substantially smaller in diameter than the outer fully open ends of baskets 17 so that as retaining plate 29 is bolted down, the portions of the plate between openings 36 randomly and confiningly engage the end of respective basket. In this instance, plate 29 also serves as a stop engageable by cleaning device 24 when the latter enters basket 17.

To keep the pressure drop through the exchanger from increasing undesirably, the number and size of plate openings 36 is such that the total cross-sectional area of openings 36 in any one plate 29 is about equal to or greater than the sum of the internal cross-sectional areas of tubes 5.

Although the drawings illustrate the aspects of the invention as applied to tube sheet 6, it is contemplated that the same construction would normally be used in connection with tube sheet 7.

Various modes of carrying out the invention are contemplated as being within the scope of the following claims particularly pointing out and distinctly claiming the subject matter which is regarded as the invention.

We claim:

1. In combination in a heat exchanger having a housing, and having a plurality of longitudinally extending fluid flow tubes disposed within said housing and having tube sheets disposed within said housing and with said tube sheets having openings in communication with the ends of said tubes:

(a) a retaining plate, (b) means fixedly mounting said plate in spaced relationship to the outer face of a said tube sheet, (c) and a plurality of baskets for receiving shuttling tube cleaning elements, with each of said plurality of baskets being mounted coaxially with a respective tube sheet opening and having longitudinally extending walls with fluid flow openings therein, (d) the outer end portion of each said basket being confiningly engaged by said retaining plate, (e) each said basket extending between said plate and said tube sheet with its said fluid flow openings disposed in the space therebetween.

2. The combination of claim 1:

(a) in which said retaining plate is provided with a plurality of spaced fluid flow openings, (b) said plate openings being in axial alignment with said tube sheet openings.

3. The combination of claim 2 in which:

(a) said baskets have open outer ends, (b) and said plate openings are in axial registry with said outer ends of said baskets.

4. The combination of claim 3 in which the outer ends of said baskets are confiningly engaged by the portions of said plate which peripherally surround said plate openings.

5. The combination of claim 3 in which the outer end portions of said basket walls provide abutment means confiningly engaged by the portions of said plate which peripherally surround said plate openings.

6. The combination of claim 1 in which said retaining plate is provided with a plurality of spaced fluid flow openings disposed in a random pattern generally out of axial alignment with said tube sheet openings.

7. The combination of claim 6 in which the portions of said retainer plate between said random openings confiningly engage the outer ends of said baskets.

8. The combination of claim 7 in which said random plate openings are smaller in diameter than the outer ends of said baskets.

9. The combination of claim 8 in which said retainer plate also serves as a stop for cleaning elements entering said baskets.

10. The combination of claim 6, 7, 8 or 9 in which the number and size of said random plate openings is such that the total cross-sectional area thereof in said plate is at least equal to the sum of the internal cross-sectional areas of said heat exchanger tubes.

* * * * *